US006381982B1

(12) United States Patent
Kim

(10) Patent No.: US 6,381,982 B1
(45) Date of Patent: May 7, 2002

(54) COOLING AIR CIRCULATING SYSTEM FOR USE IN A REFRIGERATOR

(75) Inventor: Byeong Sun Kim, Seoul (KR)

(73) Assignee: Daewoo Electronics Co., Ltd., Seoul (KR)

( * ) Notice: Subject to any disclaimer, the term of this patent is extended or adjusted under 35 U.S.C. 154(b) by 0 days.

(21) Appl. No.: 09/562,950

(22) Filed: May 3, 2000

(30) Foreign Application Priority Data

Oct. 20, 1999 (KR) ..... 99-45511
Oct. 20, 1999 (KR) ..... 99-45512

(51) Int. Cl.[7] ..... F25D 17/04
(52) U.S. Cl. ..... 62/407; 62/411; 62/441
(58) Field of Search ..... 62/407, 404, 411, 62/419, 408, 441, DIG. 16, 186, 426, 179, 157

(56) References Cited

U.S. PATENT DOCUMENTS 4,077,229 A 3/1978 Gelbard et al.
5,285,655 A 2/1994 Sung-Il et al.
5,323,624 A 6/1994 Schwalm
5,826,437 A * 10/1998 Kim
5,875,642 A * 3/1999 Lee et al.
5,896,748 A * 4/1999 Park ..... 62/441 X
5,992,164 A * 11/1999 Kim ..... 62/441 X
5,997,254 A 12/1999 Tosaki
6,041,616 A * 3/2000 Jeong ..... 62/419 X

FOREIGN PATENT DOCUMENTS

KR 928447 5/1992

* cited by examiner

*Primary Examiner*—Denise L. Esquivel
*Assistant Examiner*—Chen-Wen Jiang
(74) *Attorney, Agent, or Firm*—Pennie & Edmonds LLP

(57) ABSTRACT

A cooling air circulating system for use in a refrigerator includes a blower installed at a substantially upper central portion of back of a freezer chamber, for supplying a cooling air from an evaporator into the freezer chamber, a first cooling air supplying duct for guiding a cooling air from the evaporator into a refrigerator chamber, the cooling air supplying duct downwardly, linearly extending from the blower to a substantially upper central portion of back of the refrigerator chamber and then being horizontally, linearly branched into a left and a right sides of the refrigerator chamber, a cooling air supplying device provided at the branched portion of the first cooling air supplying duct, for supplying the cooling air from the evaporator into the refrigerator chamber through the first cooling air supplying duct, and a second cooling air supplying duct for allowing the cooling air supplying device to supply the cooling air from the evaporator into the refrigerator chamber.

6 Claims, 6 Drawing Sheets

COOLING AIR CIRCULATING SYSTEM FOR USE IN A REFRIGERATOR

FIELD OF THE INVENTION

The present invention relates to a refrigerator; and, more particularly, to a cooling air circulating system for use therein.

BACKGROUND OF THE INVENTION

There is shown in FIG. 1 a cross sectional view of a refrigerator employing a conventional cooling air circulating system.

As shown, the refrigerator 10 includes a freezer chamber 20 at its upper part, a refrigerator chamber 22 at its lower part, a compartment 24 positioned between the freezer chamber 20 and the refrigerator chamber 22 and a cooling air circulating system.

The cooling air circulating system has an evaporator 30 for cooling air therearound at back of the freezer chamber 20, a first blower 32 installed at an upper back of the freezer chamber 20, for supplying the cooling air into the freezer chamber 20, a second blower 34 (see FIG. 2) installed at a vicinity of the first blower 32, for supplying the cooling air into the refrigerator chamber 22, a louver 36 formed with a plurality of holes 38 through which the cooling air is supplied into the freezer chamber 20 and positioned between the freezer chamber 20 and the evaporator 30, and a duct system for guiding the air.

The duct system includes a first cooling air return duct 42 provided at the compartment 24 in such a way that the freezer chamber 20 is communicated with the evaporator 30, for returning the air in the freezer chamber 20 to the evaporator 30, a second cooling air return duct 44 provided at the compartment 30 in such a way that the refrigerator chamber 22 is communicated with the evaporator 30, for returning the air in the refrigerator chamber 22 to the evaporator 30, and a cooling air supplying duct 46 provided at the back side 12 of the refrigerator 10, for guiding the cooling air from the evaporator 30 to the refrigerator chamber 22. As shown in FIG. 2, the cooling air supplying duct 46 downwardly, linearly extends from an upper right side of back of the freezer chamber 20 and then branches into a left and a right sides 22*a*, 22*b* of the refrigerator chamber 22 so as to feed the cooling air into the refrigerator chamber 22.

The operation of the conventional cooling air circulating system will now be described with reference to FIGS. 1 and 2.

When a door 14 of the freezer chamber 20 or a door 16 of the refrigerator chamber 22 is opened and closed, the interior temperature of the freezer or the refrigerator chambers 20, 22 increases. In this case, the temperature detecting unit (not shown) detects the increased temperature in the freezer and the refrigerator chambers 20, 22 to output the temperature detecting signal into the microcomputer (not shown). Next, the microcomputer allows a refrigerant to circulate, changing the interior temperatures of the freezer or the refrigerator chambers 20, 22 into desired temperatures.

To be more specific, the air having a relatively high temperature in the freezer chamber 20 flows toward the evaporator 30 through the first cooling air return duct 42 by means of the first blower 32, exchanging its heat with the evaporator 30. Thereafter, the air having a relatively low temperature is fed into the freezer chamber 20 through the holes 38 of the louver 36 by means of the first blower 32, resulting in maintaining the interior temperature of the freezer chamber 20 at the desired temperature.

Similarly, the air having a relatively high temperature in the refrigerator chamber 22 flows toward the evaporator 30 through the second cooling air return duct 44, exchanging its heat with the evaporator 30. The air having a relatively low temperature flows to a location at a vicinity of the branched portion of the cooling air supplying duct 46 by means of the second blower 34. Thereafter, the air having a relatively low temperature is forced into the left and the right side 22*a*, 22*b* of the refrigerator chamber 22 which, in turn, is fed into the refrigerator chamber 22, resulting in maintaining the interior temperature of the refrigerator chamber 22 at the desired temperature.

In the refrigerator employing the cooling air circulating system described above, the first blower, together with the second blower, are installed at back of the freezer chamber, which, in turn, sets a limit to the location at which the holes of the louver are formed, causing the interior temperature of the freezer chamber to be nonuniform. In addition, the second blower, together with the first blower, is located at back of the freezer chamber, which, in turn, sets a limit to the design of the cooling air supplying duct, hindering the cooling air from being uniformly distributed into the refrigerator chamber, resulting in the interior temperature of the refrigerator chamber becoming nonuniform.

SUMMARY OF THE INVENTION

It is, therefore, a primary object of the invention to provide a refrigerator including an improved cooling air circulating system.

In accordance with an aspect of the present invention, there is provided a cooling air circulating system for use in a refrigerator having a freezer chamber equipped with an evaporator and a refrigerator chamber, comprising: a blower installed at a substantially upper central portion of back of the freezer chamber, for supplying a cooling air from the evaporator into the freezer chamber, a first cooling air supplying duct for guiding a cooling air from the evaporator into the refrigerator chamber, the cooling air supplying duct downwardly, linearly extending from the blower to a substantially upper, central portion of back of the refrigerator chamber and then being horizontally, linearly branched into a left and a right sides of the refrigerator chamber, a cooling air supplying device provided at the branched portion of the first cooling air supplying duct, for supplying the cooling air from the evaporator into the refrigerator chamber through the first cooling air supplying duct, and a second cooling air supplying duct for allowing the cooling air supplying device to supply the cooling air from the evaporator into the refrigerator chamber.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
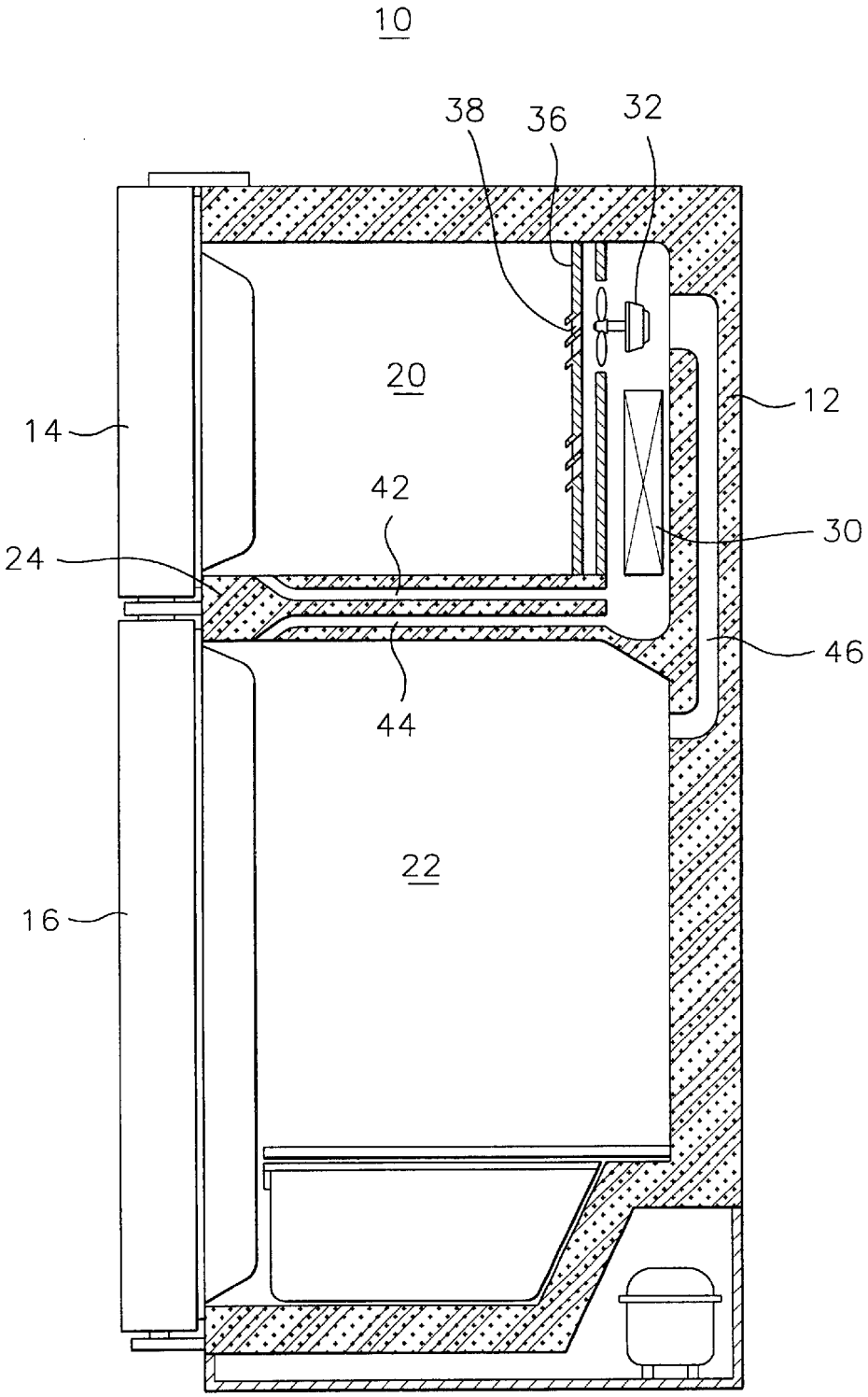
FIG. 1 (PRIOR ART)
FIG. 1 shows a cross sectional view of a refrigerator employing the conventional cooling air circulating system.
Figure 2:
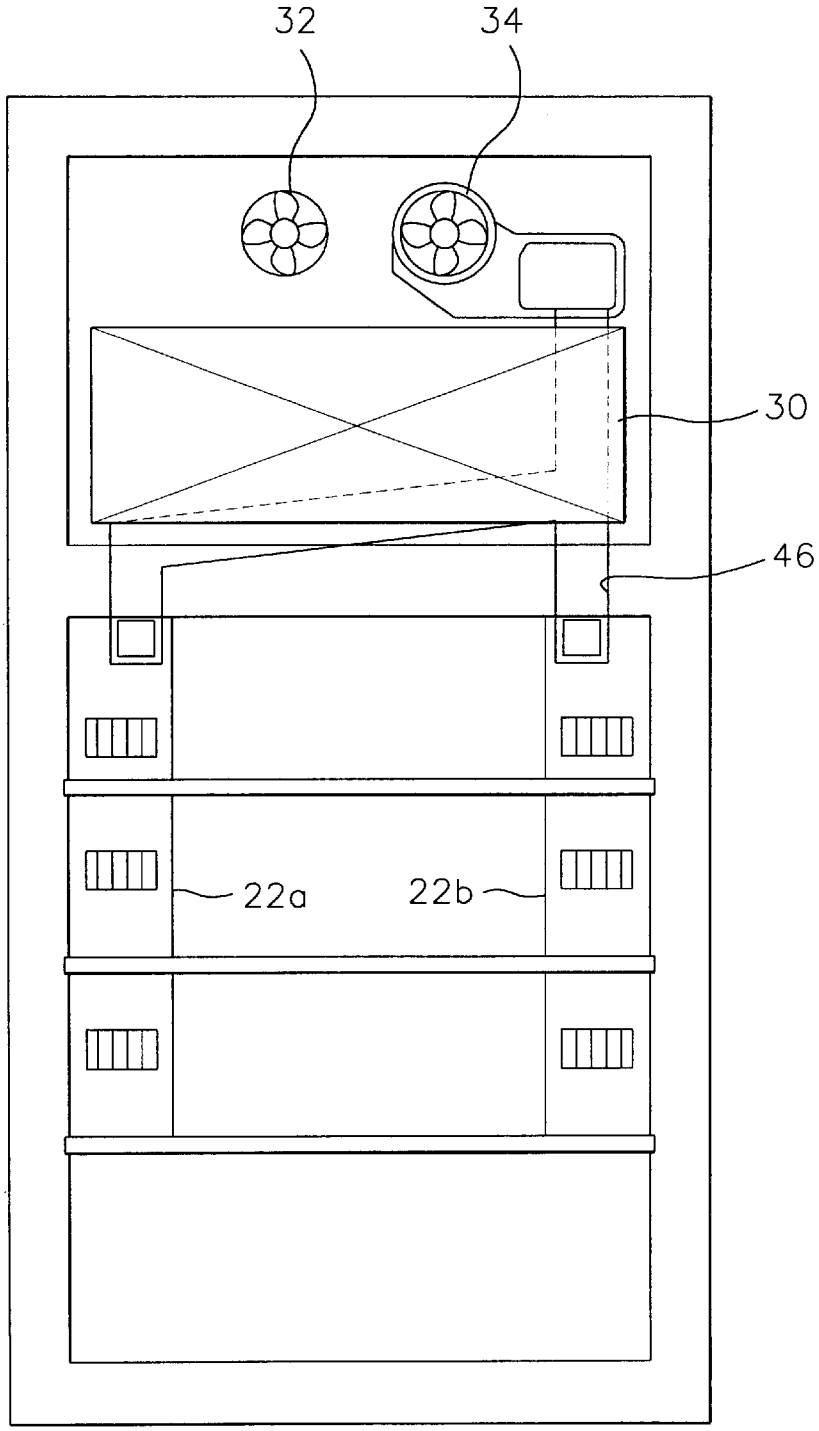
FIG. 2 (PRIOR ART)
FIG. 2 describes a front view of the refrigerator in FIG. 1, after removing doors of a freezer and a refrigerator chambers thereof.
Figure 3:
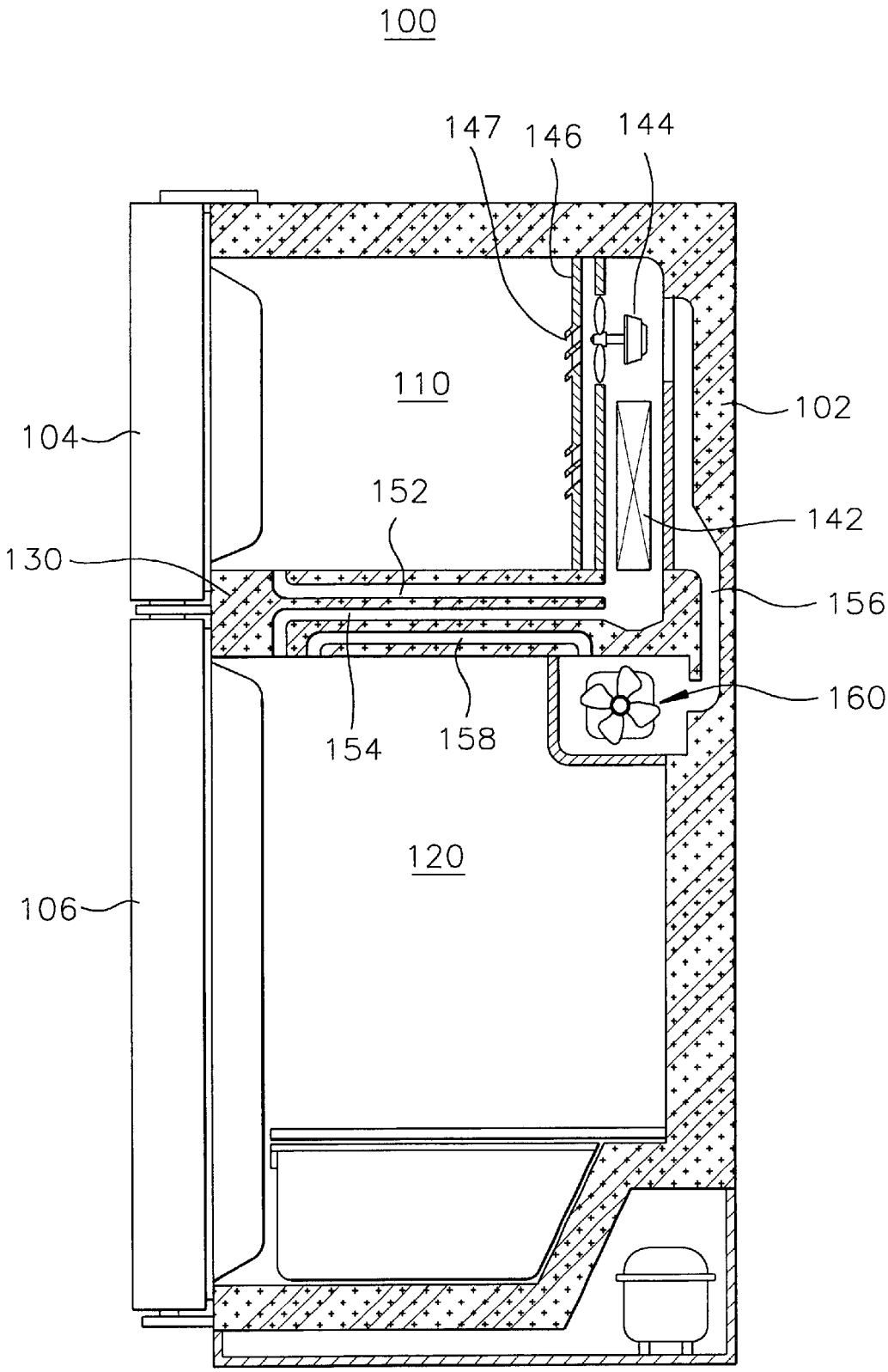
FIG. 3 illustrates a cross sectional view of a refrigerator employing a cooling air circulating system in accordance with the present invention.

Referring to FIG. 3, there is shown a cross sectional view of a refrigerator in accordance with the present invention.

As shown, the refrigerator 100 includes a freezer chamber 110 at its upper part, a refrigerator chamber 120 at its lower part, a compartment 130 positioned between the freezer chamber 110 and the refrigerator chamber 120 and a cooling air circulating system.

The cooling air circulating system has an evaporator 142 for cooling an air therearound at back of the freezer chamber 110, a blower 144 installed at a substantially upper central portion of back of the freezer chamber 110, for supplying the cooling air from the evaporator 142 into the freezer chamber 110, a louver 146 formed with a plurality of holes 147 at its central portion through which the cooling air is supplied into the freezer chamber 110 and positioned between the freezer chamber 110 and the evaporator 142, a duct system for guiding the air, and a cooling air supplying device 160 for supplying the cooling air for the evaporator 142 into the refrigerator chamber 120 at a substantially upper back of the refrigerator chamber 120.

Figure 4:
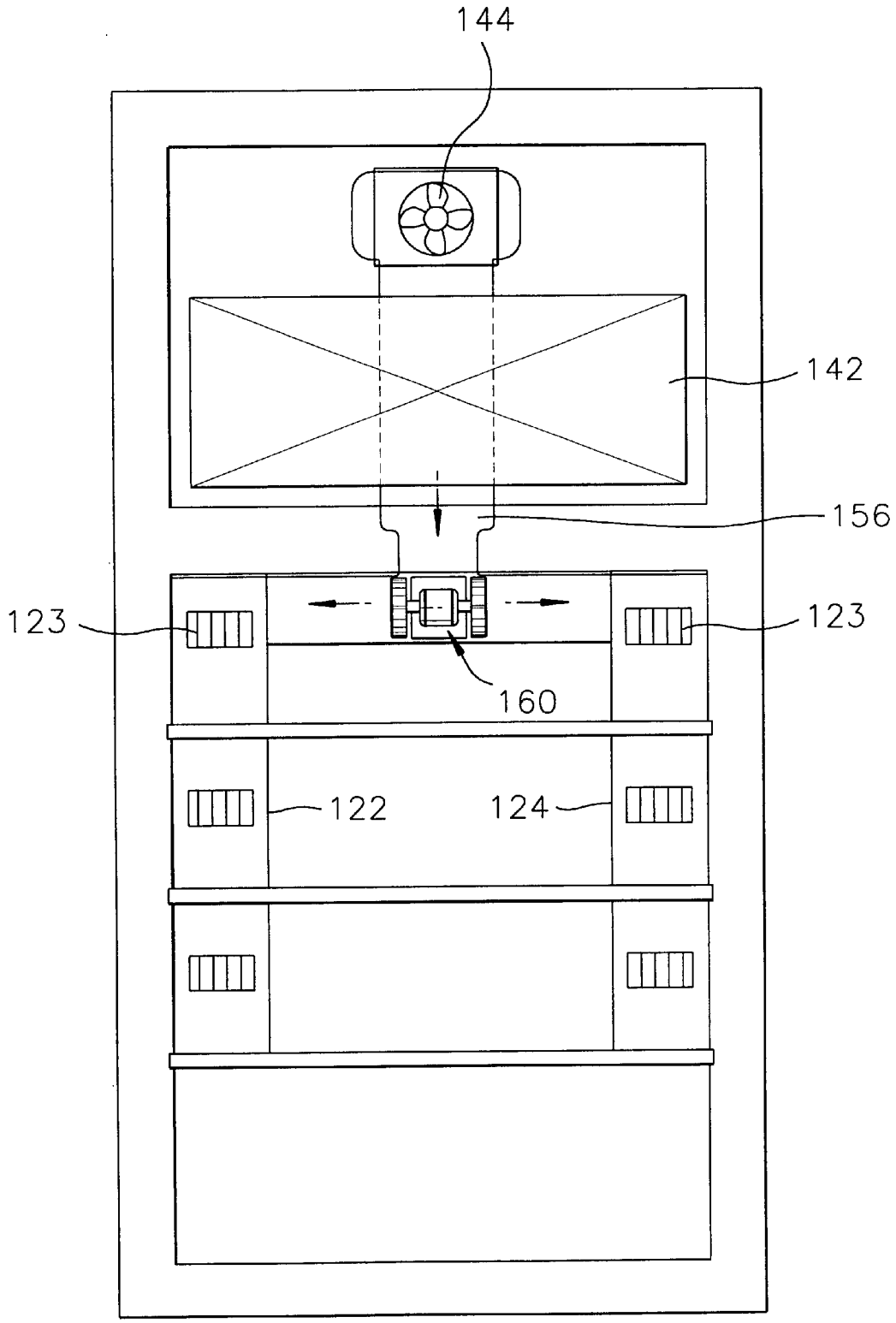
FIG. 4 displays a front view of the refrigerator in FIG. 3, after removing doors of a freezer and a refrigerator chambers thereof.

The duct system has a first cooling air return duct 152 provided at the compartment 130 in such a way that the freezer chamber 110 is communicated with the evaporator 142, for returning the air in the freezer chamber 110 to the evaporator 142, a second cooling air return duct 154 provided at the compartment 130 in such a way that the refrigerator chamber 120 is communicated with the evaporator 142, for returning the air in the refrigerator chamber 120 to the evaporator 142, a first cooling air supplying duct 156 provided at a back side 102 of the refrigerator 100 in such a way that the evaporator 142 is communicated to the cooling air supplying device 160, for guiding the cooling air from the evaporator 142 toward the cooling air supplying device 160, and a second cooling air supplying duct 158 provided at the compartment 130 in such a way that the cooling air supplying device 160 is communicated with the refrigerator chamber 120, for supplying the cooling air from the evaporator 142 into the refrigerator chamber 120 through the cooling air supplying device 160. As shown in FIG. 4, the first cooling air supplying duct 156 downwardly, linearly extends from the blower 144 to the cooling air supplying device 160 and is horizontally, linearly branched into a left and a right sides 122, 124 of the refrigerator chamber 120. The left and the right sides 122, 124 of the refrigerator chamber 120 are, respectively, provided with a plurality of discharging exits 123 for allowing the cooling air supplying device 160 to supply the cooling air from the evaporator 142 into the refrigerator chamber 120.

Figure 5:
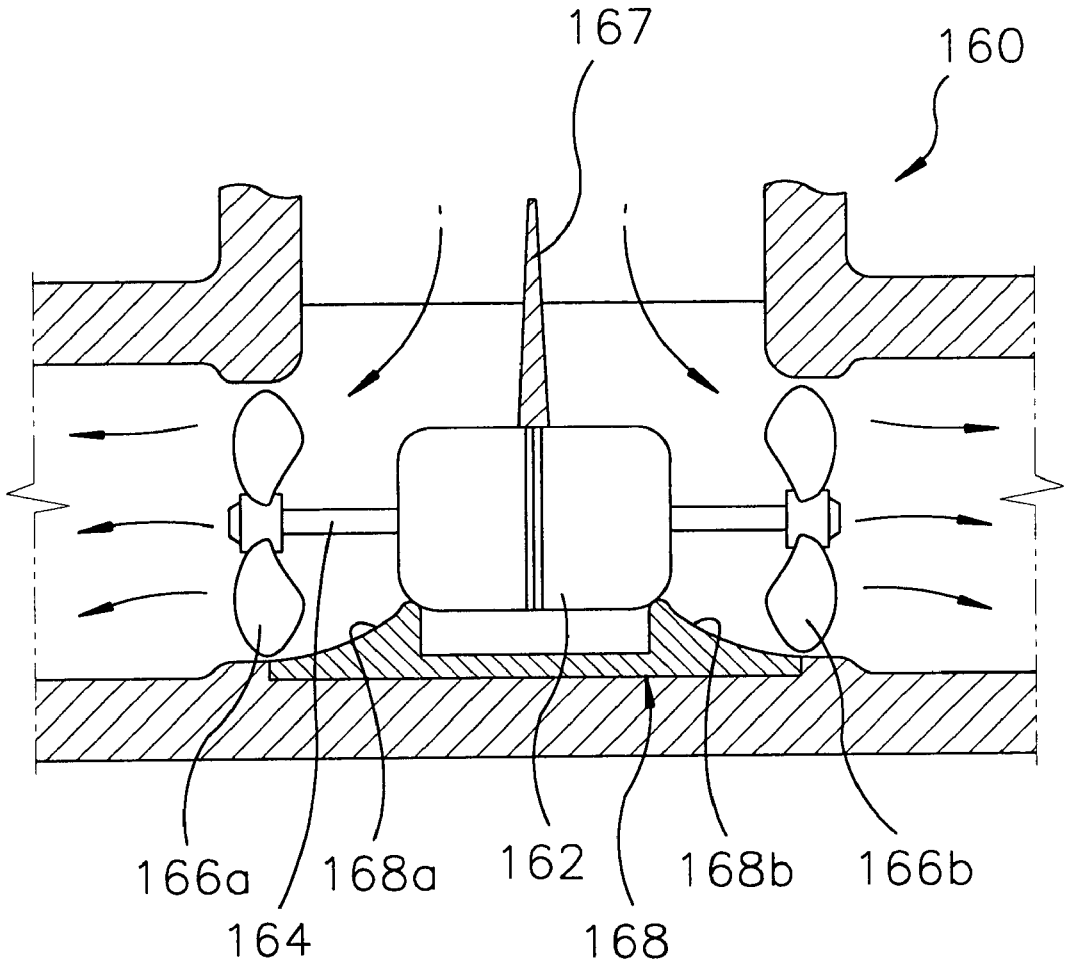
FIG. 5 depicts an arrangement of a cooling air supplying device in accordance with the present invention.

The cooling air supplying device 160 is located at a central portion of the upper back of the refrigerator chamber 120, i.e., the branched portion of the cooling air supplying duct 156 and, as shown in FIG. 5, has a motor assembly equipped with a motor 162 as a driving source and a motor shaft 164 rotated by the motor 162, a left and a right fans 166*a*, 166*b*, respectively, installed at a left and a right ends of the motor shaft 164, for supplying the cooling air into the refrigerator chamber 120, a separator 167 provided at an upper portion of the motor assembly, for dividing the cooling air into two portions in such a way that a half portion of the cooling air is guided toward the left fan 166*a* and remaining portion thereof is guided toward the right fan 166*b*, and a means for preventing the backflow of the cooling air, for example, a plate 168 installed below the motor 162. The separator 167 has a cone shape so as to smoothly divide the air and the plate 168 has a left protruding portion 168*a* between the left fan 166*a* and the motor 162 and a right protruding portion 168*b* between the right fan 166*b* and the motor 162 so as to prevent the backflow of the cooling air.

Figure 6:
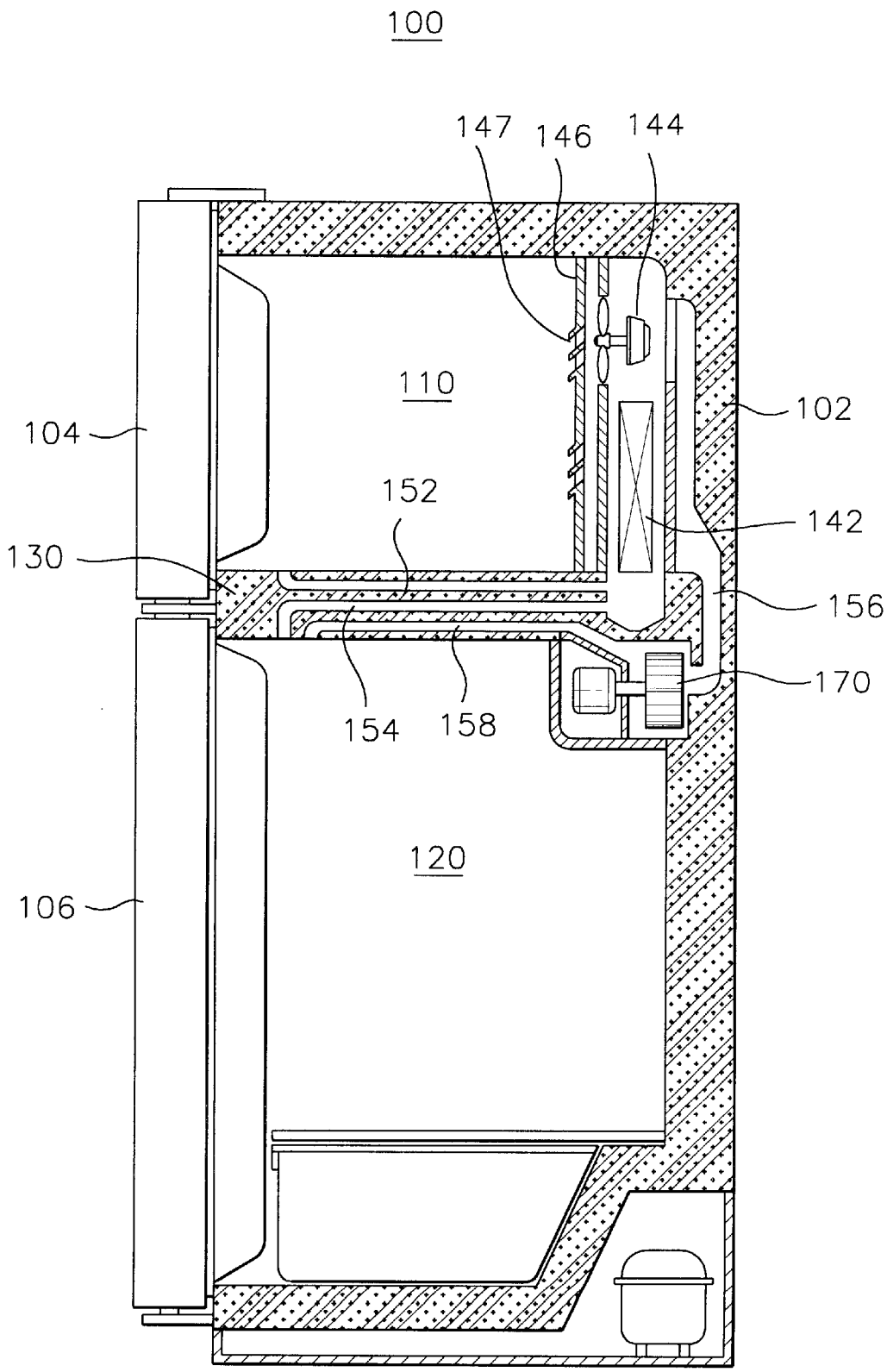
FIG. 6 discloses a cross sectional view of the refrigerator employing a sirocco fan as the cooling air supplying device in accordance with the present invention.

On the other hand, as shown in FIG. 6, the cooling air supplying device may be a sirocco fan 170.

The operation of the inventive cooling air circulating system will now be described with reference to FIGS. 3 and 4.

When a door 104 of the freezer chamber 110 or a door 106 of the refrigerator chamber 120 is opened and closed, the interior temperature of the freezer or the refrigerator chambers 110, 120 is increased. In this case, the temperature detecting unit (not shown) detects the increased temperatures of the freezer or the refrigerator chambers 110, 120 to output the temperature detecting signal into the microcomputer (not shown). Next, the microcomputer allows a refrigerant to circulate, changing the interior temperature of the freezer or the refrigerator chambers 110, 120 into desired temperatures.

To be more specific, the air having a relatively high temperature in the freezer chamber 110 flows toward the evaporator 142 through the first cooling air return duct 152 by means of the blower 144, exchanging its heat with the evaporator 142. The air having a relatively low temperature is fed into the freezer chamber 110 through the holes 147 of the louver 146 by means of the blower 144, resulting in maintaining the interior temperature of the freezer chamber 110 at the desired temperature.

Similarly, the air having a relatively high temperature in the refrigerator chamber 120 flows toward the evaporator 142 through the second cooling air return duct 154, exchanging its heat with the evaporator 142. The air Having the relatively low temperature flows to a location at a vicinity of the cooling air supplying device 160 through the first cooling air supplying duct 156 by means of the cooling air supplying device 160. Thereafter, the air having a relatively low temperature is forced into the left and the right fans 166*a*, 166*b* by the separator 167, which, in turn, is fed into the refrigerator chamber 120 through the discharging exits 123 and the second cooling air supplying duct 158, resulting in the interior temperature of the refrigerator chamber 120 being maintained at the desired temperature. In this case, the backflow of the air fed by the fans 166*a*, 166*b* is prevented by the left and the right protruding portions 168*a*, 168*b* of the plate 168.

In the refrigerator employing the cooling air circulating system described above, since the blower is installed at a substantially upper central portion of back of the freezer chamber, the holes of the louver can be formed at the central portion of the louver, allowing the interior temperature of the freezer chamber to be maintained uniformly. In addition, the cooling air supplying device is located at the central portion of the upper back of the refrigerator chamber, which, in turn, allows the cooling air supplying ducts to be simple structured and the cooling air from being uniformly distributed into the refrigerator chamber. Accordingly, the interior temperature of the refrigerator chamber becomes uniform Although the above discussions have been presented referring to a situation where the backflow preventing means is the plate having a pair of protruding portions, the backflow preventing means may be provided at the cooling air supplying duct. To be more specific, by allowing the cooling air supplying duct to have an identical shape as the protruding portions of the plate, the cooling air supplying duct can be employed as the backflow preventing means.

Although the invention has been shown and described with respect to the preferred embodiments, it will be understood by those skilled in the art that various changes and modifications may be made without departing from the scope of the invention as defined in the following claims.

What is claimed is:

1. A cooling air circulating system for use in a refrigerator having a freezer chamber equipped with an evaporator and a refrigerator chamber, comprising:

a blower installed at a substantially upper central portion of back of the freezer chamber, for supplying a cooling air from the evaporator into the freezer chamber, a first cooling air supplying duct for guiding a cooling air from the evaporator into the refrigerator chamber, the cooling air supplying duct downwardly, linearly extending from the blower to a substantially upper central portion of back of the refrigerator chamber and then being horizontally, linearly branched into a left and a right sides of the refrigerator chamber, a cooling air supplying device provided at the branched portion of the first cooling air supplying duct, for supplying the cooling air from the evaporator into the refrigerator chamber though the first cooling air supply duct;

a second cooling air supplying duct for allowing the cooling air supplying device to supply the cooing air from the evaporator into the refrigerator chamber and a compartment positioned between the freezer and the refrigerator chambers, the second cooling air supplying duct being provided at the compartment in such a way that the cooling air supplying device is communicated with the refrigerator chamber.

2. The cooling air circulating system of claim 1, further comprising a means for dividing the cooling air to be fed into the refrigerator chamber to the left and the right fans in such a way that a half portion of the cooling air is guided toward the left fan and remaining portion thereof is guided toward right fan.

3. The cooling air circulating system of claim 1, comprising a means for preventing the backflow of the cooling air fed by the fans.

4. The cooling air circulating system of claim 3 rag, wherein the backflow preventing means is a plate installed below the driving source, the plate having a pair of protruding portions which are, respectively, located between the left fan and the driving source and between the right fan and the driving source.

5. A cooling air circulating system for use in a refrigerator having a freezer chamber equipped with an evaporator and a refrigerator chamber, comprising:

a blower installed at a substantially upper central portion of back of the freezer chamber, for supplying a cooling air from the evaporator into the freezer chamber, a first cooling air supplying duct for guiding a cooling air from the evaporator into the refrigerator chamber, the cooling air supplying duct downwardly, linearly extending from the blower to a substantially upper central portion of back of the refrigerator chamber and then being horizontally, linearly branched into a left and a right sides of the refrigerator chamber, a cooling air supplying device provided at the branched portion of the first cooling air supplying duct, for supplying the cooling air from the evaporator into the refrigerator chamber through the first cooling air supplying duct; and a second cooling air supplying duct for allowing the cooling air supplying device to supply the cooling air from the evaporator into the refrigerator chamber, wherein the cooling air supplying device includes a driving source, a shaft rotated by the driving source, and a left and a right fans respectively, installed at both ends of the shaft.

6. A cooling air circulating system for use in a refrigerator having a freezer chamber equipped with an evaporator and a refrigerator chamber, comprising:

a blower installed at a substantially upper central portion of back of the freezer chamber, for supplying a cooling air from the evaporator into the freezer chamber;

a first cooling air supplying duct for guiding a cooling air from the evaporator into the refrigerator chamber, the cooling air supplying duct downwardly, linearly extending from the blower to a substantially upper central portion of back of the refrigerator chamber and then being horizontally, linearly branched into a left and a right sides of the refrigerator chamber;

a cooling air supplying device provided at the branched portion of the first cooling air supplying duct, for supplying the cooling air from the evaporator into the refrigerator chamber through the first cooling air supplying duct; and a second cooling air supplying duct for allowing the cooling air supplying device to supply the cooling air from the evaporator into the refrigerator chamber;

wherein the cooling air supplying device is a sirocco fan.

* * * * *